US007866307B2

(12) United States Patent
Monks

(10) Patent No.: US 7,866,307 B2
(45) Date of Patent: Jan. 11, 2011

(54) SELECTABLE DUAL TRIGGER MECHANISM FOR A PAINTBALL MARKER

(75) Inventor: Steven John Monks, Manchester (GB)

(73) Assignee: Planet Eclipse Limited, Trafford Park, Manchester (GB)

( * ) Notice: Subject to any disclaimer, the term of this patent is extended or adjusted under 35 U.S.C. 154(b) by 569 days.

(21) Appl. No.: 11/930,431

(22) Filed: Oct. 31, 2007

(65) Prior Publication Data

US 2008/0105243 A1 May 8, 2008

Related U.S. Application Data

(60) Provisional application No. 60/864,176, filed on Nov. 3, 2006.

(51) Int. Cl.
*F41B 11/00* (2006.01)

(52) U.S. Cl. ..... 124/32; 124/74; 124/77

(58) Field of Classification Search ..... 124/32, 124/73, 74, 77
See application file for complete search history.

(56) References Cited

U.S. PATENT DOCUMENTS 4,009,536 A * 3/1977 Wolff ..... 42/84
4,106,074 A 8/1978 Conne
4,109,557 A 8/1978 Zaucha
4,256,013 A 3/1981 Quitadama
4,298,914 A 11/1981 Long
4,495,848 A 1/1985 Rozner et al.
4,757,629 A 7/1988 Austin
4,793,085 A 12/1988 Surawski et al.
5,074,189 A * 12/1991 Kurtz ..... 89/135
5,133,030 A 7/1992 Lee
5,303,495 A 4/1994 Harthcock
5,388,749 A 2/1995 Davignon et al.
5,515,838 A 5/1996 Anderson
5,575,269 A 11/1996 Harklau
5,727,538 A 3/1998 Ellis
5,853,324 A 12/1998 Kami et al.
5,890,479 A 4/1999 Morin
5,896,691 A 4/1999 Kaminski et al.
5,924,231 A 7/1999 Kidd
5,937,558 A 8/1999 Gerard
5,947,738 A 9/1999 Muchle et al.

(Continued)

FOREIGN PATENT DOCUMENTS

EP 0276843 A2 1/1988

(Continued)

*Primary Examiner*—John Ricci
(74) *Attorney, Agent, or Firm*—Barlow, Josephs & Holmes, Ltd.

(57) ABSTRACT

A method of firing a paintball marker and dual trigger mechanism for a paintball marker are disclosed. The dual switch includes a first and a second trigger position sensors configured and arranged to detect the position of said trigger. A circuit is operatively connected to the first and second trigger position sensors and the projectile firing mechanism of the paintball marker. The circuit is configured to initiate a firing operation with said projectile firing mechanism when the first and second trigger position sensors indicate that the trigger has been depressed. The method includes the steps of detecting the position of the trigger with the first trigger position sensor and the second trigger position sensor and initiating a firing operation when the first and second trigger position sensors indicate that the trigger has been depressed.

19 Claims, 5 Drawing Sheets

U.S. PATENT DOCUMENTS 6,003,504 A * 12/1999 Rice et al. ..... 124/73
6,109,252 A 8/2000 Stevens
6,123,007 A 9/2000 O'Dwyer
6,138,656 A 10/2000 Rice et al.
6,142,137 A 11/2000 MacLaughlin
6,171,190 B1 1/2001 Thanasack
6,286,240 B1 9/2001 Collins
6,287,198 B1 9/2001 McCauley
6,302,092 B1 10/2001 Juan
6,311,682 B1 11/2001 Rice et al.
6,349,711 B1 2/2002 Perry et al.
6,354,033 B1 3/2002 Findley
6,360,736 B1 3/2002 Juan
6,474,326 B1 11/2002 Smith et al.
6,516,791 B2 2/2003 Perrone
6,565,438 B2 5/2003 Ogino
6,568,381 B2 5/2003 Chang
6,615,814 B1 9/2003 Rice et al.
6,644,296 B2 11/2003 Gardner, Jr.
6,748,938 B2 6/2004 Rice et al.
6,763,822 B1 7/2004 Styles
6,785,996 B2 9/2004 Danner et al.
6,941,693 B2 9/2005 Rice et al.
6,948,487 B2 9/2005 Rice et al.
6,966,313 B1 11/2005 Yokota et al.
7,073,284 B2 7/2006 Monks et al.
7,076,906 B2 7/2006 Monks et al.
7,089,697 B2 8/2006 Monks
7,197,843 B2 * 4/2007 Oertwig ..... 42/51
2007/0137470 A1 * 6/2007 Oertwig et al. ..... 89/28.05

FOREIGN PATENT DOCUMENTS

GB 2269655 A 2/1994
GB 2342710 A 4/2000
JP 1179898 7/1989
JP 3207998 9/1991
WO 0206754 A2 1/2002

* cited by examiner

SELECTABLE DUAL TRIGGER MECHANISM FOR A PAINTBALL MARKER

CROSS-REFERENCE TO RELATED APPLICATION

The present application claims priority to earlier filed U.S. Provisional Patent Application Ser. No. 60/864,176, filed on Nov. 3, 2006, the contents of which are incorporated herein by reference.

BACKGROUND OF THE INVENTION

1. Field of the Invention

The present invention relates generally to electrical and optical trigger mechanisms and more specifically to a dual trigger mechanism for a paintball marker.

2. Background of the Related Art

There are a number of methods employed by the manufacturers of paintball markers for detecting the movement of the trigger of a device, such as a paintball marker, in order to initiate a firing cycle. Such a firing cycle can be carried out in a purely mechanical nature where a linkage, for example, opens a valve to release air for launching. Alternatively, an electrically actuatable valve, such as a solenoid valve, can be used for this purpose.

First, an electrical switch may be used. In particular, the electrical switch is in direct or indirect mechanical contact with the trigger such that when the trigger is depressed, the switch is actuated and therefore makes—or in some cases, breaks—an electrical circuit in order to generate an electrical signal which is used to initiate a firing cycle.

Second, an optical sensor assembly may be used. The optical sensor assembly includes an emitter which typically, but not exclusively, emits infra-red radiation and a receiver; the assembly is mounted in such a way as to generate an electrical signal which varies in magnitude in relation to the position of the trigger, without having any mechanical contact with the trigger; the firing cycle is initiated when the magnitude of the signal reaches a preset level.

Each of these methods has advantages and disadvantages. In particular, the electrical switch mechanically "clicks" when actuated which provides positive tactile feedback to the user, which some users find desirable. The switch is also internally sprung in order to return the switch to its non-actuated position which removes the need for an external trigger return mechanism and also provides the user with further tactile feedback. However, switches are prone to electrical noise from a phenomenon common to all electrical switches called "switch contact bounce," which can result in unwanted firing cycle initiation. To counteract switch contact bounce electrical or software filtering of the switch generated electrical signal is required. Furthermore, an electrical switch can only generate a digital signal, where the switch is either actuated or not, which limits how easily the electrical noise can be filtered.

The optical sensor does not suffer from switch contact bounce as there are no electrical contacts and the analogue electrical signal provides better monitoring of the trigger position. Also, because the sensor assembly has no moving parts it is not prone to wear and tear. However, the non-contact arrangement of the sensor means that there is no return mechanism for the trigger, which means that an external trigger return mechanism is required. Furthermore, the non-contact arrangement provides no tactile feedback in the form of a "click," which many users find desirable.

Typically, paintball marker users will prefer one system or the other which means that the market for a product which uses one system over the other is divided. It is therefore commercially advantageous for a paintball marker to satisfy both groups of users.

Additionally, in the prior art, it is know that it is possible, on only one pull of the trigger of a paintball marker, to issue multiple firing signals to fire multiple paintballs. In electronic markers, a single trigger pull can cause switch contact bounce resulting in multiple firings. Also, in all types of markers it is possible to exploit the recoil of the marker during firing while holding the trigger down to enable the marker to fire automatically without pulling the trigger again. This phenomenon is referred to within the art as "mechanical bounce" or "trigger bounce" and is undesirable, particularly in tournament play.

SUMMARY OF THE INVENTION

The present invention solves the problems of the prior art by providing a dual trigger mechanism that is selectable by the user to use either an electrical switch, an optical sensor switch or both as desired. Furthermore the invention of the present invention eliminates "mechanical bounce" operation of a paintball marker.

The dual switch includes a first and a second trigger position sensors configured and arranged to detect the position of said trigger. A circuit is operatively connected to the first and second trigger position sensors and the projectile firing mechanism of the paintball marker. The circuit is configured to initiate a firing operation with the projectile firing mechanism when the first and second trigger position sensors indicate that the trigger has been depressed. The method includes the steps of detecting the position of the trigger with the first trigger position sensor and the second trigger position sensor and initiating a firing operation when the first and second trigger position sensors indicate that the trigger has been depressed.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

In an effort to provide a complete solution that will overcome the problems associated with each system, the present invention proposes a dual trigger mechanism, which combines an electrical switch with an optical sensor assembly in order to produce a mechanism which has all of the advantages of each type of system and none of the disadvantages.

Figure 1:
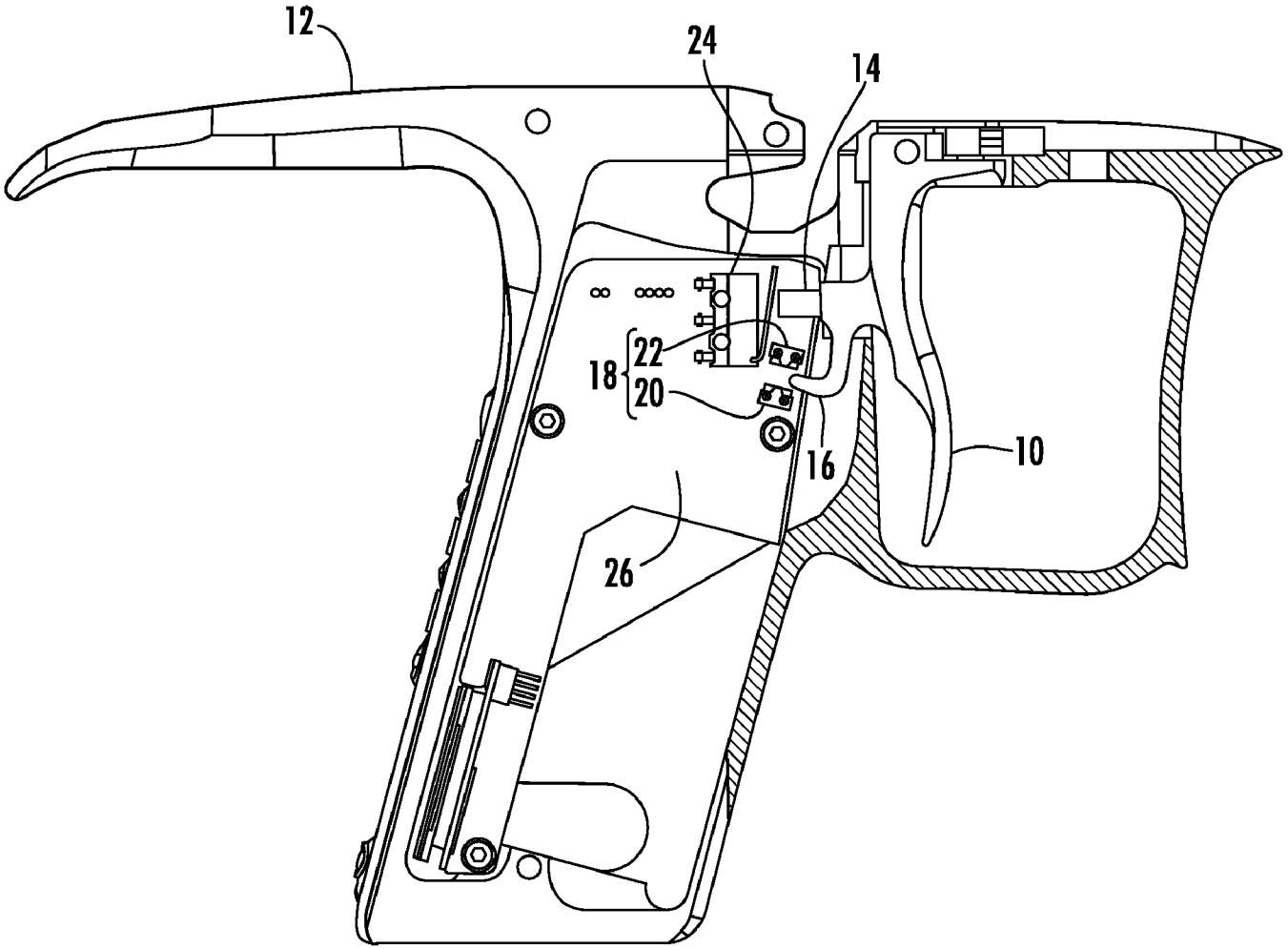
FIG. 1 is a cross-section view of a grip of a paintball marker, which illustrates the dual switch mechanism of the present invention.
Figure 2:
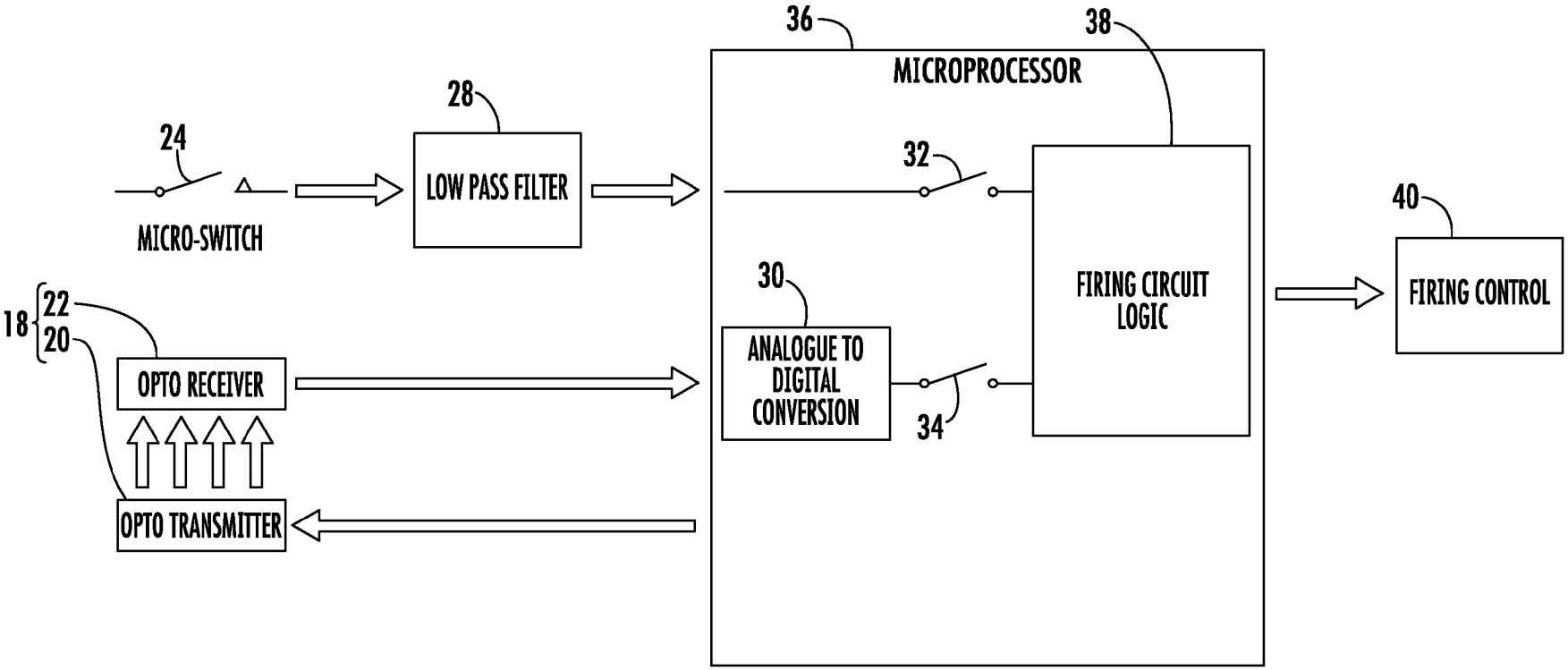
FIG. 2 is a block diagram of the circuit for the dual trigger mechanism.

Referring now to FIGS. 1 and 2, the dual trigger mechanism of the present invention comprises a trigger 10 mechanically connected to and movable within a grip frame 12 of a paintball marker. The trigger 10 may be configured to pivot or slide and be spring-biased as desired. The trigger 10 further includes two prongs 14, 16, one of which has either a fixed or an adjustable length, the other of which has an adjustable length. An optical sensor assembly 18 is also provided and includes an emitter 22, which emits electromagnetic radiation, such as infra-red or visible light radiation, and a receiver 20 which receives the radiation. The optical sensor assembly 18 is mounted in such a way that one prong, prong 16, for instance, on the trigger 10 interrupts the passage of radiation from the emitter 22 to the receiver 20 as the trigger 10 is pivoted or slid from a "released" position at one end of its range of travel to a "depressed" position at the other end of its range of travel. The second prong 14 makes contact with an actuator of an electrical switch 24, such that the actuator is actuated as the trigger 10 is depressed. A compact micro switch is preferable for use as the electrical switch 24. However, any type of switch or sensor may be used. The length of this second prong 14 can be adjusted in order to move the actuation point with respect to the trigger travel, or to remove any contact between the prong 14 and the switch 24 altogether. It is also possible that prong 16 is adjustable.

Both the switch 24 and the optical sensor assembly 18 are electrically connected to an electronic circuit board 26 which also includes an electrical circuit to control the firing of the paintball marker. In the case of the micro switch 24, it may be desirable to include a low pass filter 28 to "debounce" the switch. The optical sensor assembly 18 may also be converted to a digital signal by an analog to digital converter 30.

The electrical switch 24 and optical sensor assembly 18 may be selectively enabled depending upon the desires of the user, via programmable settings 32, 34. This feature enables the user to select either the switch 24 or the optical sensor assembly 18 or both as the source of the signal that is used to initiate the firing cycle. In particular, a microprocessor 36 is provided with firing circuit logic 38, described further below and shown in FIGS. 3-5. The microprocessor 36 is electrically connected to the firing control 40 of the paintball marker. The microprocessor 36, through application of the firing circuit logic 38, determines if the preconditions for initiating a firing cycle have been met and, if so, initiates the firing control 40 of the paintball marker to discharge a paintball.

Figure 3:
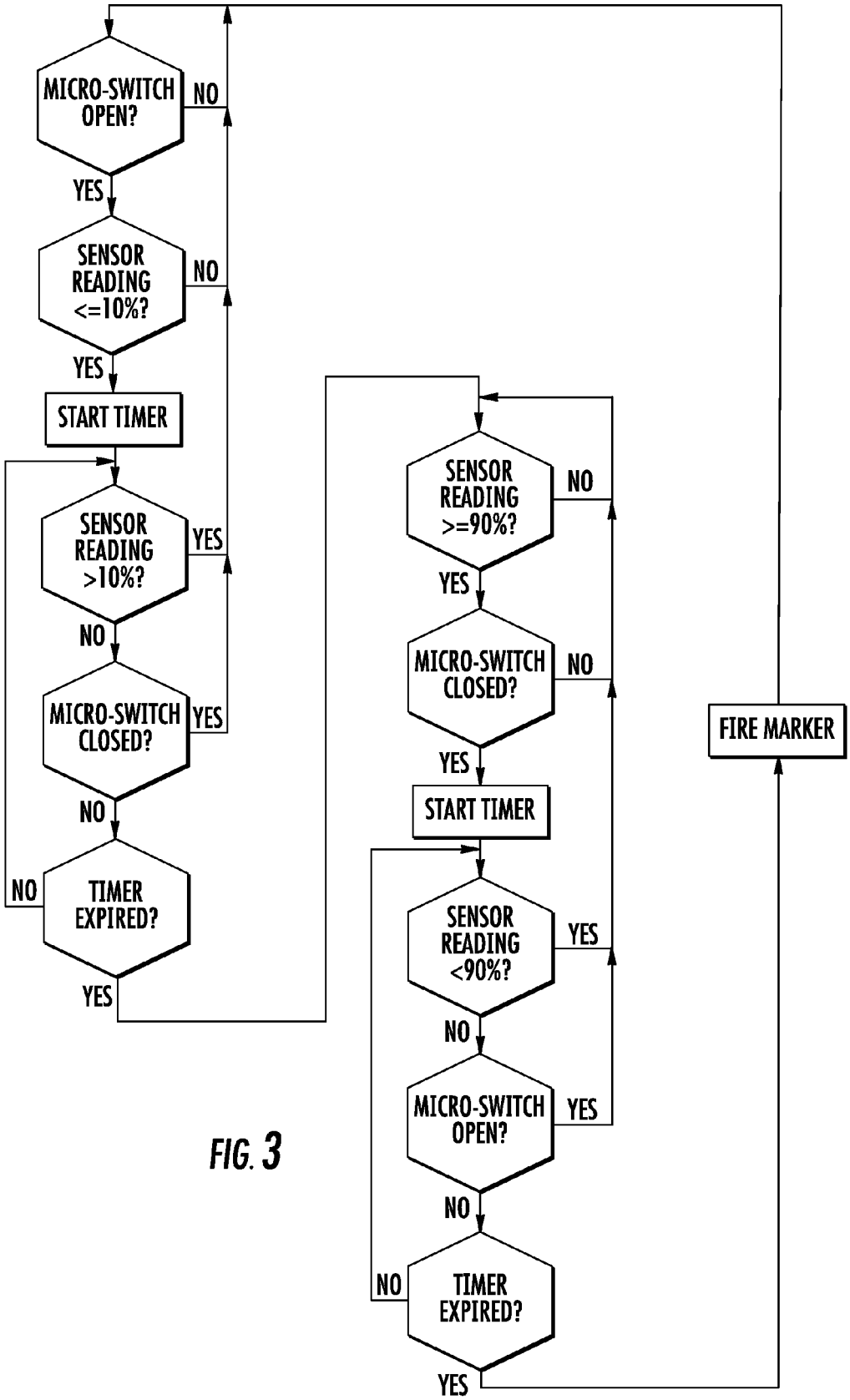
FIG. 3 is a flow diagram of the firing circuit logic when both the electrical switch and the optical sensor are enabled.

Referring to FIG. 3, during dual operation of the switches or sensors 18, 24 and prior to the first shot, when the trigger 10 is released, the micro switch 24 is open and the signal from the optical sensor 18 is at its minimum, which may be referred to as 0%. As the user starts to pull the trigger 10, the signal from the optical sensor 18 starts to increase, i.e. greater than 0%. As the user pulls the trigger 10 further the micro switch 24 is closed, which begins initiation of the firing cycle. The user then continues to pull the trigger 10 until the signal from the optical sensor 18 rises above a preset maximum level, for example 85% or 90%, to complete initiation of the firing cycle. After the firing cycle has initiated, the user begins to release the trigger 10, which subsequently opens the micro switch 24. As the user releases the trigger 10 further, the signal from the optical sensor 18 drops below a preset minimum level, for example 15% or 10%. The firing cycle can now be repeated.

In the event that the two limits of the optical sensor 18 are not reached before the micro switch 24 is closed again then one of two things can occur, both of which are designed to prevent false trigger pulls generated by the recoil of the marker (often referred to in paintball as "mechanical bounce" or "trigger bounce"). The marker can be inhibited from firing on that trigger pull and a delay can be introduced into the firing cycle in order to slow the response time. A delay may be introduced at two distinct points in the firing cycle. A first timing cycle may be initiated when the trigger 10 is released and a second timing cycle may be initiated when the trigger 10 is depressed. The first timing cycle ensures that the trigger 10 has been released for sufficient time prior to initiating a subsequent firing cycle. The second timing cycle ensures that the user depresses the trigger 10 for sufficient time prior to releasing the trigger 10 and beginning a new firing cycle. One or both delays may be adjusted to prevent mechanical bounce. Typically, these timing cycle delays are set to 8 milliseconds, but can be set anywhere between 1 and 100 milliseconds as desired.

Figure 4:
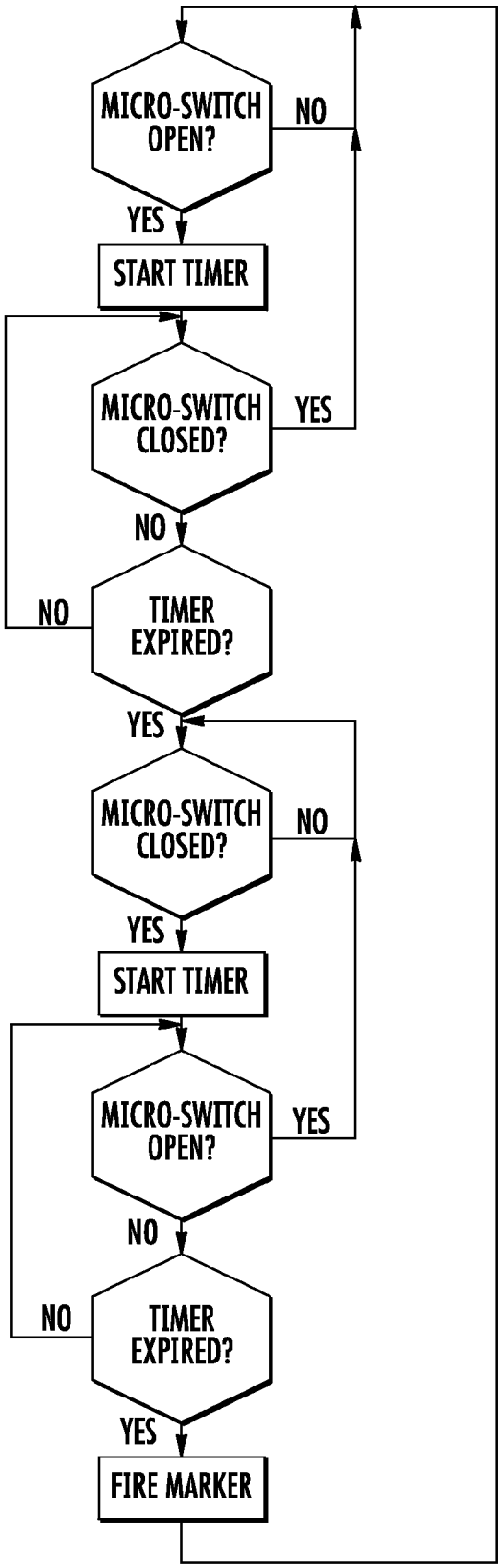
FIG. 4 is a flow diagram of the firing circuit logic when the optical sensor has been disabled.

Referring to FIG. 4, if the user disables the optical sensor 18, the firing logic for the micro switch 24 is shown. To prevent mechanical bounce, a timing delay is started and firing is inhibited. If the switch 24 is closed to early, the timing delay is reset. As the user pulls the trigger 10 and the micro switch 24 is closed, a second timing delay is calculated. The second timing delay ensures that the micro switch is held closed for sufficient time in order to begin initiation of the firing cycle. After the firing cycle has initiated, the user begins to release the trigger 10, which subsequently opens the micro switch 24. The firing cycle can now be repeated. These timing delays are fractions of second to ensure that the user is making legitimate trigger pulls rather than using mechanical bounce.

Figure 5:
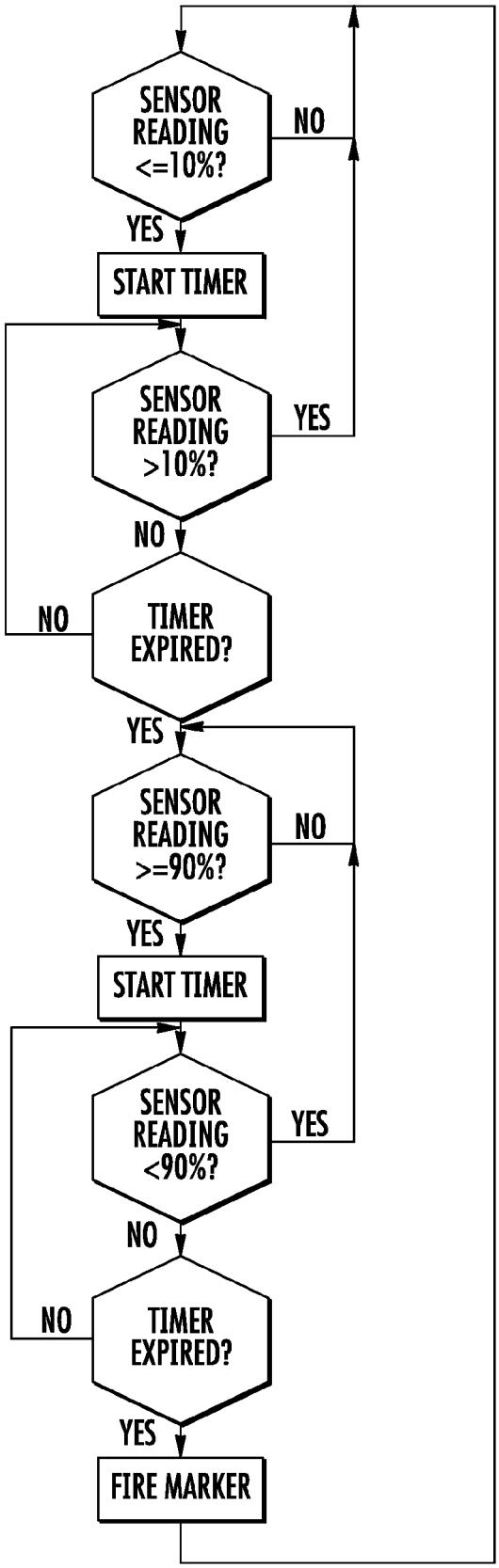
FIG. 5 is a flow diagram of the firing circuit logic when the electrical switch has been disabled.

Referring to FIG. 5, if the user disables the micro switch 24, the firing logic for the optical sensor 18 is shown. Prior to a first shot, when the trigger 10 is released, the signal from the optical sensor 18 is at its minimum. To prevent mechanical bounce, a timing delay is inserted. If the sensor reaches its critical threshold too early, the timing delay is reset and firing is inhibited. As the user starts to pull the trigger 10, the signal from the optical sensor 18 starts to increase. The user then continues to pull the trigger 10 until the signal from the optical sensor 18 rises above a preset maximum level, to complete initiation of the firing cycle. However, the user must hold the trigger 10 for sufficient time to complete initiation of the firing cycle. A second timing cycle is calculated to ensure that the user has held the trigger 10 for sufficient time and is not relying on mechanical bounce. If the user releases the trigger 10 prematurely, the second timing cycle will reset. After the firing cycle has initiated, the user begins to release the trigger 10, which subsequently allows the sensor 18 level to drop below its preset minimum level. The firing cycle can now be repeated.

Therefore, it can be seen that the present invention provides a unique solution to the problem of providing a switching mechanism for a device that includes both the tactile feel of an electrical switch and the accuracy and reliability of an optical sensor switch. Moreover, the mechanism of the present invention is user selectable, which allows the user to choose the mechanism that he or she finds most desirable. In addition, the undesirable trait of 'mechanical bounce' can be eliminated.

It would be appreciated by those skilled in the art that various changes and modifications can be made to the illustrated embodiments without departing from the spirit of the present invention. All such modifications and changes are intended to be within the scope of the present invention, except as limited by the appended claims.

What is claimed is:

1. A dual trigger mechanism for a paintball marker, said paintball marker comprising a body, a projectile firing mechanism within said body, and a trigger movably connected to said body, said dual trigger mechanism comprising:

a first trigger position sensor configured and arranged to detect the position of said trigger;

a second trigger position sensor configured and arranged to detect the position of said trigger;

a circuit operatively connected to said first trigger position sensor, said second trigger position sensor and said projectile firing mechanism;

said circuit configured and arranged to initiate a firing operation with said projectile firing mechanism when said first trigger position sensor and said second trigger position sensor indicate that the trigger has been depressed; and said circuit further configured and arranged to terminate the firing operation with said projectile firing mechanism when said first trigger position sensor and said second trigger position sensor indicate that the trigger has been released.

2. The apparatus of claim 1, wherein said first trigger position sensor is an electrical switch.

3. The apparatus of claim 2, wherein said first trigger position sensor is a microswitch.

4. The apparatus of claim 1, wherein said first trigger position sensor is an optical sensor.

5. The apparatus of claim 1, wherein said first trigger position sensor is an electrical switch and said second trigger position sensor is an optical sensor.

6. The apparatus of claim 1, wherein said first trigger position sensor may be selectively disabled.

7. The apparatus of claim 1, wherein said second trigger position sensor may be selectively disabled.

8. A dual trigger mechanism for a paintball marker, said paintball marker comprising a body, a projectile firing mechanism within said body, and a trigger movably connected to said body, said dual trigger mechanism comprising:

an electrical switch configured and arranged to close when said trigger is depressed and open when said trigger is released;

an optical sensor configured and arranged to detect the position of said trigger;

a circuit operatively connected to said electrical switch, said optical sensor and said projectile firing mechanism;

said circuit configured and arranged to initiate a firing operation with said projectile firing mechanism when said electrical switch and said optical sensor indicate that the trigger has been depressed; and said circuit further configured and arranged to terminate the firing operation with said projectile firing mechanism when said electrical switch and said optical sensor indicate that the trigger has been released.

9. The apparatus of claim 8, wherein said electrical switch may be selectively disabled.

10. The apparatus of claim 8, wherein said optical sensor may be selectively disabled.

11. A method of firing a paintball marker having a trigger, a first trigger position sensor, and a second trigger position sensor, comprising the steps of:

detecting the position of the trigger with the first trigger position sensor;

detecting the position of the trigger with the second trigger position sensor;

initiating a firing operation when said first trigger position sensor and said second trigger position sensor indicate that the trigger has been depressed; and terminating the firing operation when said first trigger position sensor and said second trigger position sensor indicate that the trigger had been released.

12. The method of claim 11, further comprising the step of:

waiting a predetermined amount of time before initiating a firing operation.

13. The method fo claim 11, further comprising the steps of:

initiating a timer; and resetting the timer if the first trigger position sensor or the second trigger position sensor indicate that the trigger has been depressed prior to the passage of a predetermined amount of time.

14. The method of claim 11, further comprising the steps of:

initiating a timer; and resetting the timer if the first trigger position sensor or the second trigger position sensor indicate that the trigger has been released prior to the passage of a predetermined amount of time.

15. The method of claim 11, wherein the step of initiating a firing operation further comprises:

allowing a firing operation only if said first trigger position sensor and said second trigger position sensor indicate that the trigger has been depressed for a predetermined duration.

16. The method of claim 11, wherein the step of initiating a firing operation further comprises:

allowing a firing operation only if said first trigger position sensor and said second trigger position sensor indicate that the trigger has been released for a predetermined duration.

17. The method of claim 11, further comprising the steps of:

initiating a timing period;

resetting said timing period if said first trigger position sensor or said second trigger position sensor indicate that the trigger has been released;

verifying said timing period is expired; and allowing a firing operation only if said first trigger position sensor and said second trigger position indicate that the trigger has been depressed for the duration of said timing period.

18. The method of claim 11, further comprising the steps of:

initiating a timing period;

resetting said timing period if said first trigger position sensor or said second trigger position sensor indicate that the trigger has been depressed;

verifying said timing period is expired; and allowing a firing operation only if said first trigger position sensor and said second trigger position sensor indicate that the trigger has been released for the duration of said timing period.

19. The method of claim 11, further comprising the steps of:

initiating a first timing period;

resetting said first timing period if said first trigger position sensor or said second trigger position sensor indicate that the trigger has been depressed verifying said first timing period is expired;

initiating a second timing period;

resetting said second timing period if said first trigger position sensor or said second trigger position sensor indicate that the trigger has been released;

verifying said second timing period is expired; and allowing a firing operation only if said first trigger position sensor and said second trigger position sensor indicate that the trigger has been released for the duration of said first timing period and said first trigger position sensor and said second trigger position sensor indicate that the trigger has been depressed for the duration of said second timing period.

* * * * *